US007133058B2

(12) United States Patent
Lee

(10) Patent No.: US 7,133,058 B2
(45) Date of Patent: Nov. 7, 2006

(54) DIGITAL THERMAL TRANSFER PRINTER

(76) Inventor: Kilhun Lee, #101, 1328-dong, Mokdongsinsigaji Apt., Sinjung-dong, Yangchon-gu, Seoul (KR) 158-070

( * ) Notice: Subject to any disclaimer, the term of this patent is extended or adjusted under 35 U.S.C. 154(b) by 192 days.

(21) Appl. No.: 10/968,653

(22) Filed: Oct. 18, 2004

(65) Prior Publication Data

US 2005/0270361 A1 Dec. 8, 2005

(30) Foreign Application Priority Data

Jun. 3, 2004 (KR) ..... 10-2004-0040469

(51) Int. Cl.
*B41J 2/315* (2006.01)

(52) U.S. Cl. ..... 347/212

(58) Field of Classification Search ..... 347/212, 347/102, 185–187, 197
See application file for complete search history.

(56) References Cited

U.S. PATENT DOCUMENTS 5,754,208 A * 5/1998 Szlucha ..... 347/102
5,757,407 A * 5/1998 Rezanka ..... 347/102
6,078,344 A * 6/2000 Wen et al. ..... 347/212
6,283,590 B1 * 9/2001 Peter ..... 347/102

* cited by examiner

*Primary Examiner*—K. Feggins
(74) *Attorney, Agent, or Firm*—Jordan and Hamburg LLP

(57) ABSTRACT

The present invention discloses a digital thermal transfer printer comprising not only several heaters drying sequentially transfer ink printed to textile materials, but also a thermal transfer moving horizontally and ejecting hot winds of 180~600° C. to heat the transfer ink directly to have the production speed of general direct printers to maximize work efficiency, to embody more clear colors of the transfer ink due to the very fast and rapid heating to the textile materials, and eventually to give more trusts to customers.

3 Claims, 4 Drawing Sheets

DIGITAL THERMAL TRANSFER PRINTER

BACKGROUND OF THE INVENTION

1. Field of the Invention

The present invention relates to a digital thermal transfer printer, and more particularly, to the digital thermal transfer printer comprising not only several heaters drying sequentially transfer ink printed to textile materials, but also a thermal transfer moving horizontally and ejecting hot winds of 180~600° C. to heat the transfer ink directly to have the production speed of general direct printers to maximize work efficiency, to embody more clear colors of the transfer ink due to the very fast and rapid heating to the textile materials, and eventually to give more trusts to customers.

2. Description of the Related Art

Recently, development of various technologies makes industry, especially industrial products, highly advanced and more competitive than ever. As a result, advertisement or design of the industrial products becomes more important factor of the product market shares. Sequentially, to get better effects of advertisement or design of the industrial products such as a banner or a curtain, various printing methods are applied to form figures or patterns to the industrial products. Thermal transfer printing method or direct printing method is one of such various printing methods.

Thermal transfer printing method utilizes heat to activate transfer ink to transfer the contents (pictures, letters, logos, or designs) described in a transfer paper to textile materials or other transfer objects (an iron plate, a tile, a film, etc). The procedure of such thermal transfer printing method will be explained briefly in the following statement.

Pictures, letters, logos, or designs are inputted to, and edited by a computer. Those edited contents (pictures, letters, logos, or designs) are transformed to a transfer paper, and cut into various shapes, which is called a cutting process. While preparing an original copy of the edited contents through manual works, a transfer object, such as a wood-free paper or a textile material, is arranged. Sequentially, the contents are transferred to the transfer object by utilizing a thermal transfer, which is called a transfer process.

However, the thermal transfer printing method described in the above statements is used to manufacture a banner or a flag in general, and is not suitable to describe various colorful images. Therefore, to describe various colorful images, additional offset printing process is applied. In other words, a print film describing the colorful images is prepared additionally, and transferred to a transfer paper by utilizing transfer ink, which is called the offset printing process.

As described in the above statements, the process transferring the colorful images requests to manufacture additional print film. Therefore, it is troublesome works, and in more, spends too much time and expenses to prepare a sample of the print film.

Particularly, in a process of a small quantity batch production, the print film should be prepared to each colorful image, respectively. Therefore, the print film is hardly prepared because of the problems of time and expenses.

On the contrary, the direct printing method different from the heat transfer printing method utilizing heat, is mostly applied to manufacture all kinds of banners. After editing designs by computer, the direct printing method applies a digital printer, shown in FIG. 1, to manufacture the banners immediately. Therefore, the direct printing method printing the banners through the digital printer directly does not require the process of preparing the print film, and eventually save time and expenses.

However, the direct printing method utilizing the digital printer should adopt an exclusive paper manufactured specially, and does not apply to general textile materials.

In other words, the drying temperature using hot winds at the digital printer is about 60° C., manufacturing efficiency is extremely low so that it takes too much time to dry completely the transfer ink printed to the exclusive paper. In more, the low drying temperature makes the color of the transfer ink change to hardly express the natural color sense of the designs. Therefore, the direct printing method makes merchantability of the product low, and does not provide satisfaction to customers.

SUMMARY OF THE INVENTION

To overcome the above described problems, preferred embodiments of the present invention provide a digital thermal transfer printer comprising not only several heaters drying sequentially transfer ink printed to textile materials, but also a thermal transfer moving horizontally and ejecting hot winds of 180~600° C. to heat the transfer ink directly to have the production speed of general direct printers to maximize work efficiency, to embody more clear colors of the transfer ink due to the very fast and rapid heating to the textile materials, and eventually to give more trusts to customers.

The purpose of the present invention is to provide a digital thermal transfer printer with a supporter with a predetermined height, a transfer zone including a transfer roller connected with a power transfer on a base, and a main body including a head moving horizontally at the top of the base to print transfer data to the transfer object by transfer ink ejected from ink cartridge, comprising: a surface guide at the bottom of the base to contact continuously with the one surface of a printed transfer object; a guide roller installed respectively at the front side and the rear side of the surface guide, to make the printed transfer object approached closely to the surface guide; a guide rail installed to the supporter under the right bottom of the surface guide; a transfer at the guide rail, including a motor to move horizontally; a heater at the inside of a heating case coupled with the transfer, to generate hot heat; and a ventilation fan ejecting forcedly the heat from the heater to the surface guide through a hot wind ejector of the heating case In more, the digital thermal transfer printer of the present invention comprises multiple heaters to each of the top of the inside of the base contacted with the printed transfer object, the side area of the base, and the surface guide, respectively.

In more, the digital thermal transfer printer of the present invention comprises guide stoppers installed respectively at the left and right sides of the guide rail along to the width of the transfer object, to control the left or the right transfer distances of the transfer.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFFERED EMBODIMENTS

Reference will now be made in detail to preferred embodiments of the present invention, example of which is illustrated in the accompanying drawings.

Figure 1:
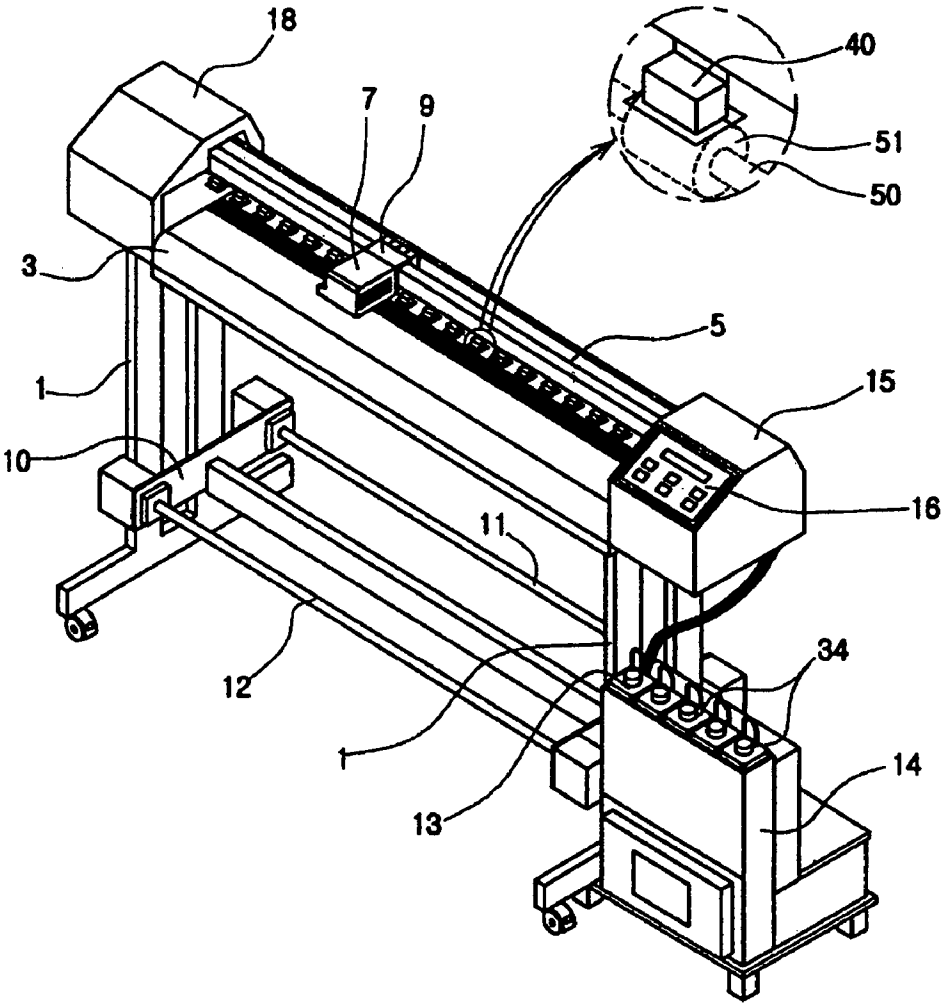
FIG. 1 is a configurative diagram of a conventional digital printer.
Figure 2:
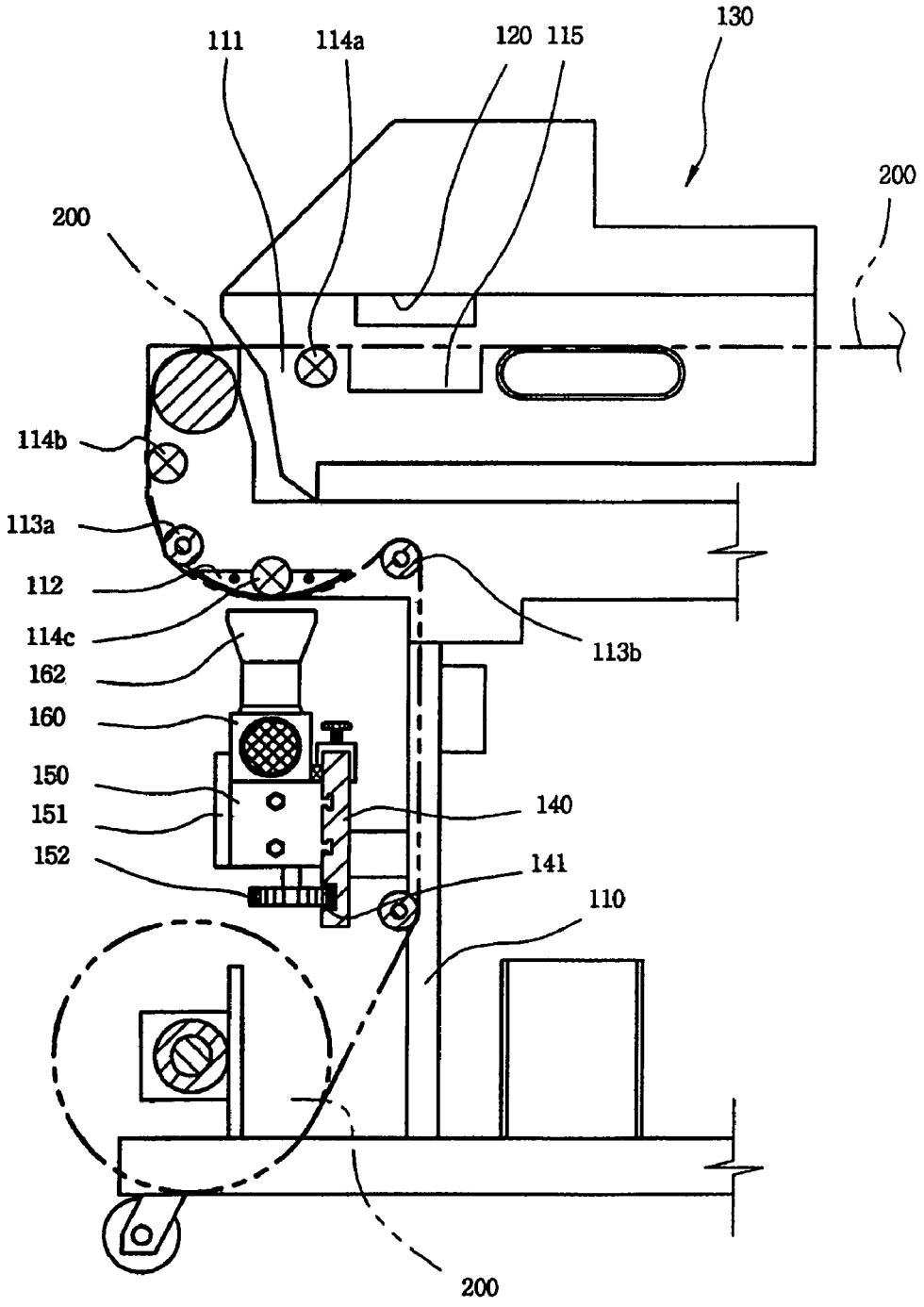
FIG. 2 is a side view of a digital thermal transfer printer of the present invention.
Figure 3:
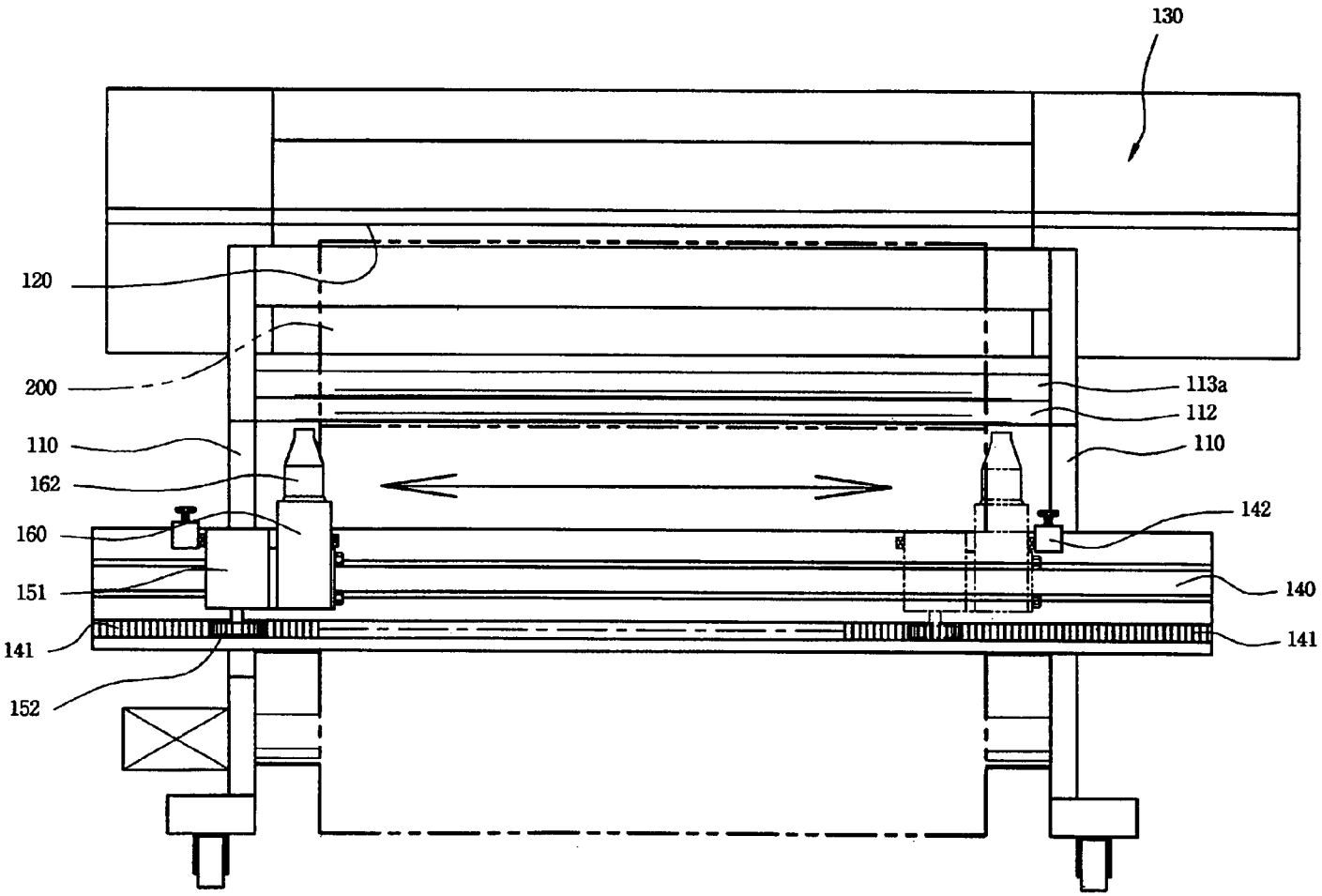
FIG. 3 is a front view of the digital thermal transfer printer of the present invention.

FIG. 2 is a side view, and FIG. 3 is a front view of a digital thermal transfer printer of the present invention.

The digital thermal transfer printer of the present invention comprises a supporter 110 with a predetermined height, a transfer zone 120 including a transfer roller (not shown) connected with a power transfer (not shown) on a base 111 placed under a transfer object 200 such as textile materials to make the transfer object 200 flat, and a main body 130 including a head 131 moving horizontally at the top of the base 111 to print transfer data such as designs to the transfer object by transfer ink ejected from ink cartridge.

In more, the one surface of the printed transfer object 200 is continuously contacted with a surface guide 112 formed in the bottom of the base 111. Additionally, guiding rollers 113*a* and 113*b*, installed respectively at the front side and the rear side of the surface guide 112, make the printed transfer object 200 approached closely to the surface guide 112.

In more, heaters 114*a*, 114*b*, and 114*c* installed to each of the top of the inside of the base 111 contacted with the printed transfer object 200, the side area of the base 111, and the surface guide 112, respectively, make the transfer ink at the printed transfer object 200 dried sequentially.

Figure 4:
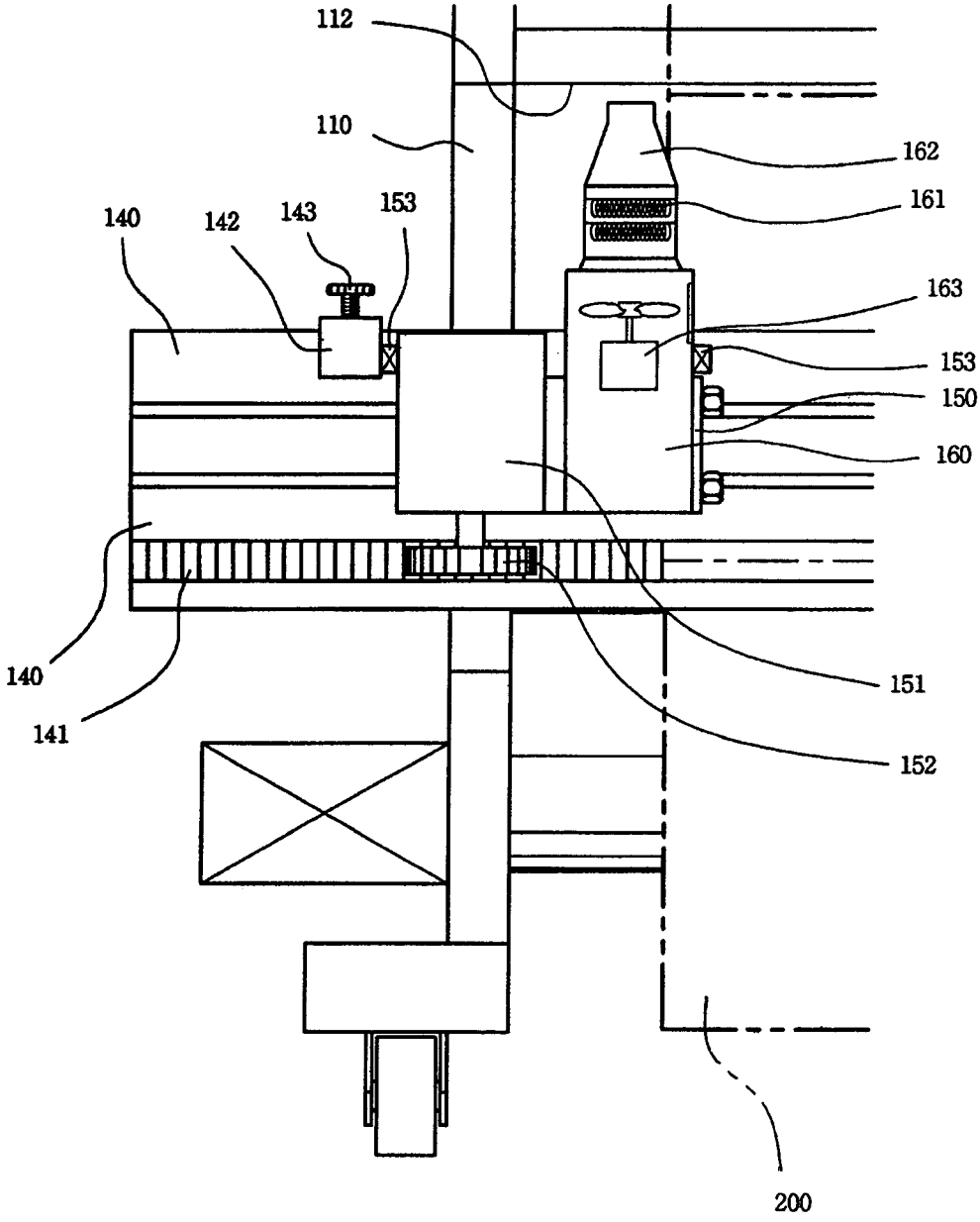
FIG. 4 is a front view of an essential part of the digital thermal transfer printer of the present invention.

In more, it is preferable that a collection hole 115 preventing spreading of the transfer ink printed to the transfer object 200 is formed on the top of the base 111 at predetermined intervals As shown in FIG. 3 and FIG. 4, a guide rail 140 is installed to the supporter 110 under the right bottom of the surface guide 112, and a transfer 150 moving horizontally is installed to the guide rail 140. A gear 152, of a motor 151 of the transfer 150, reducing speed to a predetermined magnitude is engaged with a rack gear 141 of the guide rail 140 to make the transfer 150 move horizontally.

In more, guide stoppers 42 installed respectively at the left and right sides of the guide rail 140 along to the width of the transfer object 200, control the left or the right transfer distances of the transfer 150. The guide stopper 142 is slid into the guide rail 140, and fixed in a predetermined position by a fixing bolt 143. The fixed guide stopper 142 is contacted with a limit switch 153 of the transfer 150 to determine the left or the right transfer distances of the transfer 150.

In more, a thermal transfer blowing hot wind is installed to the transfer 150, and a heater 161 generating hot heat of about 180~600° C. is included in the inside of a heating case 160 of the thermal transfer. At the top of the heating case 160, a hot wind ejector 162 is installed to eject heat from the heater 161 to the surface guide 112. In more, a ventilation fan 163 is installed in the inside of the hot wind ejector 162. The temperature of the heater 161 is adjusted between 180° C. and 600° C. according to the thickness and material of the transfer object 200, and to the transfer ink.

Functions of the digital thermal transfer printer embedding a thermal transfer described in the above statements will be described in more detail.

At the bottom of the transfer zone 120 guiding the head 131 to move horizontally, the base 111 is installed to the longitudinal direction of the transfer zone 120. The initial part of the transfer object 200 wound in a feeding roller (not shown) is located to the top of a supply roller by an operator at first, and the transfer object 200 becomes to be continuously supplied. At this moment, after positioning the guide stopper 142 to the guide rail 140 as wide as the width of the transfer object 200, the guide stopper 142 is fixed by utilizing the fixing bolt 143.

At the same time, powers is applied to the heaters 114*a*, 114*b*, and 114*c* installed to each of the top of the inside of the base 111, the side of the base 111, and the surface guide 112, respectively, and the heaters 114*a*, 114*b*, and 114*c* is heated up to a predetermined temperature.

The transfer object 200 located to the supply roller is supplied in a predetermined length to the front side of the base 111, after the head 131 completes print operations. The collection hole 115 of the transfer ink included at the top side of the base 111 absorbs the transfer ink printed to the transfer object 200 to prevent spreading of the transfer ink.

In more, the transfer object 200 supplied to the front side of the collection hole 115 is dried sequentially by the heaters 114*a*, 114*b*, and 114*c* installed respectively to each of the top of the inside of the base 111, the side of the base 111, and the surface guide 112.

Additionally, when the printed part of the transfer object 200 is transferred into the surface guide 112, the transfer 150 installed to the guide rail 140 is operated. As shown in FIG. 4, the heater 161 in the inside of the heating case 160 is heated up to about 600° C. at this moment, and the heated hot wind is forcedly ejected through the hot wind ejector 162 by the ventilation fan 163. Therefore, The transfer object 200 of the surface guide 112 is rapidly heated up to complete transfer operations.

At the same time, the gear 152 of the motor 151 of the transfer 150 is engaged with the rack gear 141 of the guide rail 140, so that the transfer 150 is moved horizontally and repeatedly to heat up rapidly the transfer object 200 of the surface guide 112.

In more, the limit switch 153 of the transfer 150 is contacted with the guide stopper 142 so that the left or the right transfer distances of the transfer 150 is determined.

Therefore, the digital thermal transfer printer of the present invention comprising not only several heaters drying sequentially transfer ink printed to textile materials, but also a thermal transfer moving horizontally and ejecting hot winds of 180~600° C. heats the transfer ink directly to have the production speed of general direct printers to maximize work efficiency, embodies more clear colors of the transfer ink due to the very fast and rapid heating to the textile materials, and eventually gives more trusts to customers.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A digital thermal transfer printer with a supporter with a predetermined height, a transfer zone including a transfer roller connected with a power transfer on a base, and a main body including a head moving horizontally at the top of the base to print transfer data to the transfer object by transfer ink ejected from ink cartridge, comprising:

a surface guide at the bottom of the base to contact continuously with one surface of a printed transfer object;

a guide roller installed respectively at a front side and a rear side of the surface guide, to make the printed transfer object approached closely to the surface guide;

a guide rail installed to a supporter under a right bottom of the surface guide;

a transfer at the guide rail, including a motor to move horizontally;

a heater inside of a heating case coupled with the transfer, to generate hot heat; and a ventilation fan ejecting forcedly the heat from the heater to the surface guide through a hot wind ejector of the heating case.

2. The digital thermal transfer printer according to claim 1, further comprising multiple heaters to each of the top of the inside of the base contacted with the printed transfer object, a side area of the base, and the surface guide, respectively.

3. The digital thermal transfer printer according to claim 1, further comprising guide stoppers installed respectively at the left and right sides of the guide rail along to the width of the transfer object, to control the left or the right transfer distances of the transfer.

* * * * *